US007198519B2

(12) United States Patent
Regnier et al.

(10) Patent No.: US 7,198,519 B2
(45) Date of Patent: Apr. 3, 2007

(54) EDGE CARD CONNECTOR ASSEMBLY WITH KEYING MEANS FOR ENSURING PROPER CONNECTION

(75) Inventors: Kent Regnier, Lombard, IL (US); Jay H. Neer, Boca Raton, FL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/176,474

(22) Filed: Jul. 7, 2005

(65) Prior Publication Data

US 2006/0009080 A1 Jan. 12, 2006

Related U.S. Application Data

(60) Provisional application No. 60/586,488, filed on Jul. 7, 2004.

(51) Int. Cl.
*H01R 24/00* (2006.01)

(52) U.S. Cl. ..... 439/637; 439/680

(58) Field of Classification Search ..... 439/637, 439/64, 630, 660, 495, 260, 326, 680
See application file for complete search history.

(56) References Cited

U.S. PATENT DOCUMENTS

| | | | | |
|---|---|---|---|---|
| 3,264,599 | A | 8/1966 | Kinkaid | |
| 4,403,819 | A | 9/1983 | Weber | |
| 4,568,133 | A | 2/1986 | Amano et al. | |
| 5,425,651 | A * | 6/1995 | Thrush et al. | 439/326 |
| 5,520,555 | A * | 5/1996 | Taylor | 439/680 |
| 5,554,036 | A | 9/1996 | Shirai et al. | |
| 5,775,938 | A * | 7/1998 | Noro et al. | 439/495 |
| 5,890,931 | A | 4/1999 | Ittah et al. | |
| 5,989,040 | A | 11/1999 | Nishimatsu | |
| 6,283,796 | B1 | 9/2001 | Yeh | |
| 6,302,744 | B1 | 10/2001 | Nomura | |
| 6,394,823 | B1 * | 5/2002 | Dunham et al. | 439/108 |
| 6,464,521 | B1 * | 10/2002 | Kurotori et al. | 439/260 |
| 6,644,995 | B1 * | 11/2003 | Jones et al. | 439/260 |
| 6,695,647 | B2 * | 2/2004 | Tsai | 439/630 |
| 6,702,619 | B2 * | 3/2004 | Kuroda et al. | 439/637 |
| 6,733,343 | B2 * | 5/2004 | Morita et al. | 439/680 |

(Continued)

OTHER PUBLICATIONS

Siemens Components, "Reliable Polarization and Pre-Centering with Connectors", vol. 24, No. 4, Aug. 1989.

(Continued)

*Primary Examiner*—Gary F. Paumen
(74) *Attorney, Agent, or Firm*—Thomas D. Paulius

(57) ABSTRACT

A surface mount connector for high speed data transfer application has an insulative housing with a circuit card-receiving slot disposed along a front face thereof. A plurality of conductive terminals are supported by the housing so that contact portions of the terminals extend into the card slot. The terminals are supported on opposite faces of the connector housing, specifically the top and bottom faces thereof, and each of the terminals includes a tail portion, a contact portion and a retention portion that engages the connector housing so that the contact portions are cantilevered in their extent within the housing. The housing includes a hollow recess formed on its bottom that opens to the front of the connector housing. This recess serves as a keyway that may receive a male portion of an opposing mating connector to ensure the mating connector is oriented properly before engagement.

17 Claims, 13 Drawing Sheets

U.S. PATENT DOCUMENTS

| | | | | |
|---|---|---|---|---|
| 6,790,055 | B1 * | 9/2004 | Shiu et al. | 439/79 |
| 7,025,617 | B2 | 4/2006 | Regnier et al. | |
| 7,048,567 | B2 | 5/2006 | Regnier et al. | |
| 2002/0009914 | A1 * | 1/2002 | Yahiro et al. | 439/326 |
| 2002/0045381 | A1 * | 4/2002 | Ishii et al. | 439/495 |
| 2004/0152352 | A1 * | 8/2004 | Tsai | 439/326 |
| 2006/0009080 | A1 | 1/2006 | Regnier et al. | |
| 2006/0014438 | A1 | 1/2006 | Regnier et al. | |
| 2006/0019525 | A1 | 1/2006 | Lloyd et al. | |
| 2006/0040556 | A1 | 2/2006 | Neer et al. | |
| 2006/0160429 | A1 | 7/2006 | Dawiedczyk et al. | |
| 2006/0189180 | A1 | 8/2006 | Lang et al. | |

OTHER PUBLICATIONS

Siemens Components, "Reliable Polarization and Pre-Centering with Connectors", vol. 24 No. 4, Aug. 1989.

International Search Report of copending International Patent Application No. PCT/US2005/024476, Oct. 31, 2005.

* cited by examiner (PRIOR ART)

EDGE CARD CONNECTOR ASSEMBLY WITH KEYING MEANS FOR ENSURING PROPER CONNECTION

REFERENCE TO RELATED APPLICATIONS

This application claims priority from U.S. Provisional Patent Application No. 60/586,488, filed Jul. 7, 2004.

BACKGROUND OF THE INVENTION

The present invention is directed generally to edge card connectors and, more specifically to edge card connectors in which the connector impedance may be controlled by shaping of the connector terminals and in which the connector includes a means for ensuring proper connection with an opposing, mating connector.

High speed data transfer systems require electrical connectors in which the electrical impedance can be controlled in order to maintain the required data transfer rate of the electrical system. It is desirable at high speed data transfer rates to obtain a specific impedance in a connector that matches the impedance of the entire electronic system, i.e., the circuits on a circuit board of an electronic device and either the circuits of opposing electronic device or in a transmission cable. The impedance of a connector may be controlled by the spacing of the terminals, the size of the terminals and the thickness and location of material within the connector housing.

However, low profile connectors, such as those used in SFP (Small Form Factor Pluggable) and SFP-like applications are desired in electronic devices in which space is a premium and thus it is difficult to control the impedance by modifying the spacing and size of the terminals in a reduced-size connector housing. When the terminals are modified, it becomes difficult to retain all of the mechanical functions of the connector, such as terminal retention and engagement while tuning the impedance of the connector. It is also difficult, due to the small size of the SFP-style connectors to provide the connector with some sort of keying function that will ensure proper mating with an opposing mating connector.

The present invention is directed to an improved electrical connector system that combines the aforementioned characteristics and which provides terminals that are capable of accommodating high data transfer speeds of approximately 2 gigabits per second and greater up to and exceeding 10 gigabits per second, and which includes a means for indicating to a user of the system that an opposing, mating connector is properly oriented to mate with the connector.

SUMMARY OF THE INVENTION

Accordingly, it is a general object of the present invention to provide a low profile connector in which the terminals may have varying shapes for controlling the impedance of the connector and in which the connector housing includes means for orienting an opposing connector for mating with the connector housing.

Another object of the present invention to provide a surface mount style connector for mounting on a circuit board, the connector having a plurality of conductive terminals supported therein in spaced apart order, the terminals having stubs formed as part thereof, thereby reducing and/or increasing the amount of metal to influence the capacitance and/or the inductance of the terminals and control the impedance thereof.

A still further object of the present invention is to provide a small form factor connector for receiving the edge of a circuit card therein and providing a connection between circuits on the circuit card and circuits on larger circuit boards, the connector having an insulative housing having a slot disposed therein along a mating face for receiving the edge of the circuit card therein, and the connector housing further having two terminal insertion faces disposed therein, each of the faces including a plurality of terminal-receiving slots, the terminal-receiving slots being disposed on opposite sides of the connector housing to facilitate insertion of the terminals therein.

Yet another object of the present invention is to provide a high speed connector of small form factor having an insulative housing and terminals supported by the housing along two opposing surfaces of the housing, each of the terminals including a contact portion that extends in a forward direction of the connector housing and a tail portion that extends in a rearward direction of the connector housing, each of the terminals further including a retention portion disposed intermediate the contact and tail portions thereof, the retention portion being received within individual retention cavities that extend transversely to the card-receiving slot.

Another object of the present invention is to provide a high speed connector having an insulative housing with defined top, bottom and side surfaces, the connector housing accommodating a plurality of conductive terminals that are inserted into terminal-receiving cavities disposed in the top and bottom surfaces of the connector housing, the bottom surface of the connector housing being configured to define a recess between it and a top surface of a circuit board to which the connector housing may be mounted, the recess being sized sufficiently to receive a projection from an opposing mating connector to thereby provide a means for ensuring proper engagement between the connector housing and the opposing mating-connector, without adversely affecting the structural integrity of the connector.

Yet a further object of the present invention is to provide a small size connector suitable for use in small form factor applications, the connector including a housing that supports a plurality of conductive terminals that are arranged in two distinct terminal sets on opposite surfaces of the connector, the terminal including surface mount feet that extend outwardly from the connector housing proximate a rear portion thereof, the terminal feet of one terminal set extending out from a first base portion of the connector housing and the terminal feet of another distinct terminal set extending out from a second base portion of the connector housing.

A still other object of the present invention is to provide a receptacle connector that has a housing with a contacts inserted into it from the bottom face, and a hollow cavity defined along the bottom of the connector housing which accommodates a projection from a mating plug connector, the projections serving in effect as a cover to the bottom contacts when the plug connector is mated to the receptacle connector, the cover of the plug connector protecting the bottom contacts of the receptacle connector from electrostatic discharge (ESD) and also preventing the contacts from acquiring contaminants during handling.

The present invention accomplishes the aforementioned and other objects by the way of its structure.

In one embodiment of the invention, a connector assembly is provided for mounting to a circuit board with surface mount technology. The connector includes a dielectric housing and terminals of a first type which are stamped from a metal strip and are inserted into slots in a front face of the connector housing. Terminals of a second type are stamped from a second metal strip and are inserted into slots along the rear face of the connector housing so the first and second type terminals are opposing each other. The first and second sets of terminals are inserted into the connector housing along two distinct faces of the housing, which are preferably on opposite ends of the housing.

The first and second type terminals have cantilevered contact arm portions that extend into an internal receptacle of the connector housing which is designed to receive the edge of a circuit card or other mating portion of a plug connector. The terminals all preferably have contact portions, tail portions, intervening body portions and terminal retention portions that are press fit into slots formed in the connector housing.

In the preferred embodiment of the invention, the terminals are divided into two distinct sets of terminals that are spaced apart from each other on opposite sides of the circuit card-receiving slot of the connector housing. The terminals are inserted into the connector housing from two opposite sides of the housing, preferably the top and bottom sides of the housing. Using this connector housing structure, the terminal may be reduced in size, yet still maintain their overall cantilevered configuration. Each terminal has a contact portion and a tail portion. The tail portions of the terminals of this embodiment include surface mount feet that preferably extend at an angle so that they are oriented parallel to the circuit board to which the connector is mounted. The terminals may also include through hole tails that extend at an angle to the circuit board.

Each terminal includes a contact portion and a body portion that extends between the contact and tail portions. The terminals are received in terminal-receiving cavities that extend lengthwise through the connector housing in a staggered arrangement so that the terminals of one of the two distinct terminal sets are staggered with respect to the terminals of the other of the two distinct terminal sets. The terminal body portions further include retention portions that preferably take the form of stubs that extend out at an angle to the body portions and the stubs are received within slots that extend at an angle, preferably inwardly of the connector housing, to the main terminal-receiving cavities of the connector housing. The retention portions engage the connector housing along a rear wall thereof.

The connector housing may include two base portions which are spaced lengthwise apart from each other. Each of these base portions preferably supports a single set of terminals near the tail portions thereof. With this arrangement, the bottom of the connector housing may be hollowed out to form a recess that opens to the front of the connector and which is closed of by one of the two base portions at the rear of the recess. This recess is configured to receive a projection from an opposing mating connector in the form of a plug connector. This recess permits a user to ensure that the opposing mating connector will be properly inserted into and mated with the connectors of the invention. This recess does not reduce the overall structural integrity of the connectors of the invention, and the location of the slots that receive the retention members also does not reduce the structural integrity of the connectors of the invention.

These and other objects, features and advantages of the present invention will be clearly understood through a consideration of the following detailed description.

BRIEF DESCRIPTION OF THE DRAWINGS

In the course of this detailed description, the reference will be frequently made to the attached drawings in which.

DETAILED DESCRIPTION OF THE PREFERRED EMBODIMENTS

Figure 1:
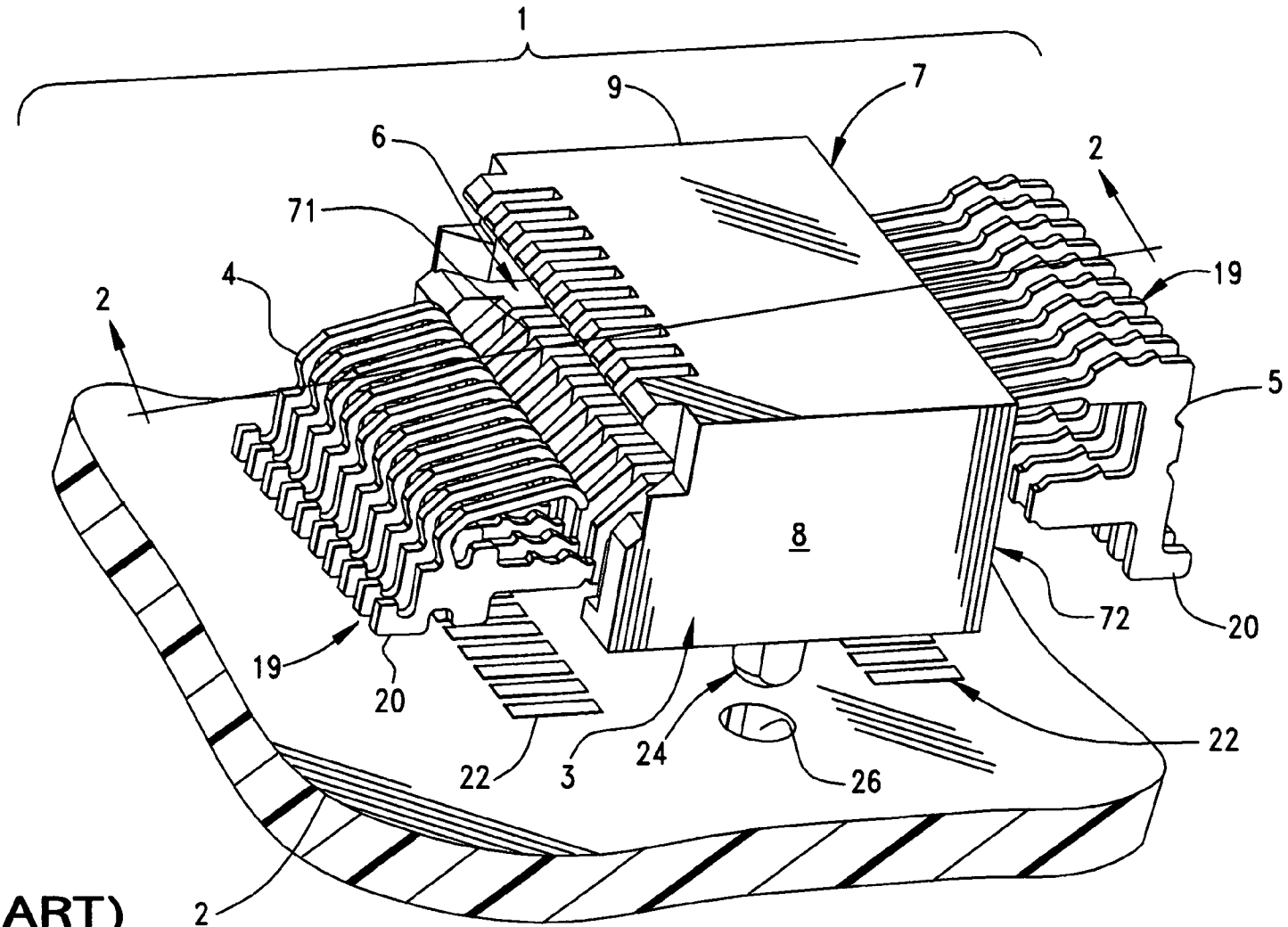
FIG. 1 (PRIOR ART)
FIG. 1 is an exploded perspective view of a known connector assembly illustrating one type of circuit board application to which the present invention is directed.

FIG. 1 illustrates a known connector assembly, generally designated as 1, that will be used to explain the environment in which the present invention operates. The connector assembly 1 is a surface-mount style and is intended for mounting to a printed circuit board 2. The connector assembly includes an insulative housing 3, preferably formed from a dielectric material, and a plurality of conductive terminals 19 are supported in the housing 3. The terminals 19 are arranged in two distinct sets of first terminals 4 and second terminals 5. This connector represents a connector structure that is commonly used in Small Form Pluggable-module applications.

The connector housing has a configuration which includes a plurality of distinct faces and these faces include a first, or front face 6 and an opposing second, or rear face, 7. Side faces or sidewalls 8, 9 are seen to interconnect the front and rear faces 6, 7 of the housing together, and in the embodiment illustrated, the housing. The first face 6 of the connector housing may be considered as a mating face of the connector inasmuch as it contains a slot formed therein for receiving an edge of a circuit board or edge card therein, and the second face 7 of the connector housing may be considered as a mounting face inasmuch as a portion of the connector, by way of the rear terminals, is mounted to the circuit board 2.

The first terminals 4 are mounted into slots 71 formed in the connector housing 3 along its front face 6, while the second terminals 5 are mounted in slots 72 that are formed in the connector housing 3 along its rear face 7. The front and rear faces 6, 7 are oriented substantially perpendicular to the printed circuit board 2 onto which the connector housing 3 is mounted. Mounting portions 20 formed in the terminals 19 are located on the terminals 19 in locations spaced away from the connector housing 3 and serve as a means for connecting the terminals of the connector to corresponding conductive pads 22 formed with the circuit board 2 in a surface mount manner. These mounting portions are illustrated as conventional surface mount tails. The connector housing 3 may also include mounting pegs, or posts 24 formed therewith that are received within complementary openings 26 formed with the circuit board 2. This Figure depicts one of the connector environments in which the terminals and connectors of the present invention may be used.

Figure 2:
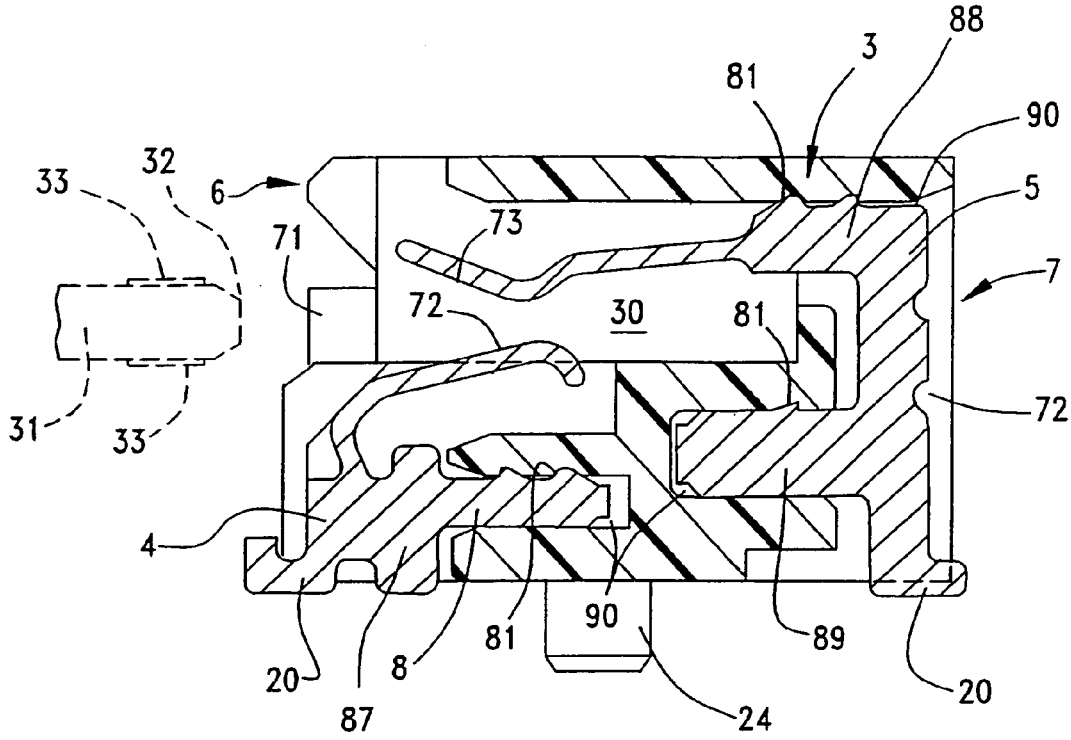
FIG.2 (PRIOR ART)
FIG. 2 is a cross-sectional view of the connector assembly of FIG. 1 taken along line 2—2 thereof, removed from the circuit board and illustrating the housing, its mating slot and the positioning of first and second terminals therein.

FIG. 2 illustrates, in cross-section, the connector housing 3 of FIG. 1. This view shows the position of the two sets of terminals 4, 5. The connector housing 3 includes an internal cavity, or receptacle 30, which receives an insertion edge 32 of an edge card 31, illustrated in phantom. The two terminals 4, 5 each have contact arm portions 72, 73 that extend in a cantilevered fashion, from body portions 87, 88, into the internal receptacle 30 along opposite sides thereof in opposition to circuit pads 33 arranged on the circuit card 31. The terminals 4, 5 may also include terminal retention portions 8 & 89 which may or may not form part of the terminal body portions. These retention portions include one or more teeth or barbs, 81, that skive, or cut, into the connector housing material along the edges of the three retention slots 90 which are shown in the Figure.

Figure 3:
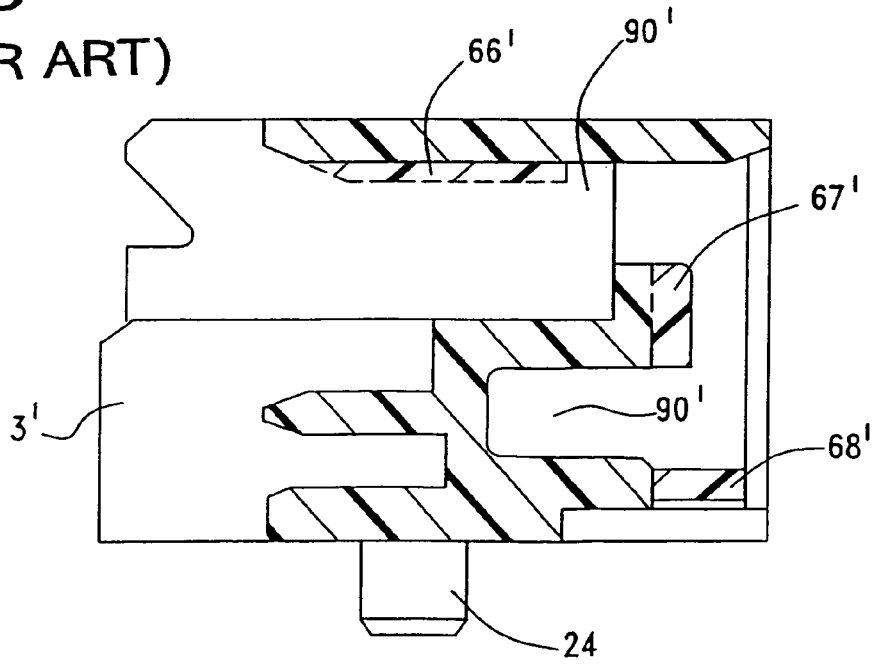
FIG.3 (PRIOR ART)
FIG. 3 is a cross-sectional view of another know connector housing.
Figure 4:
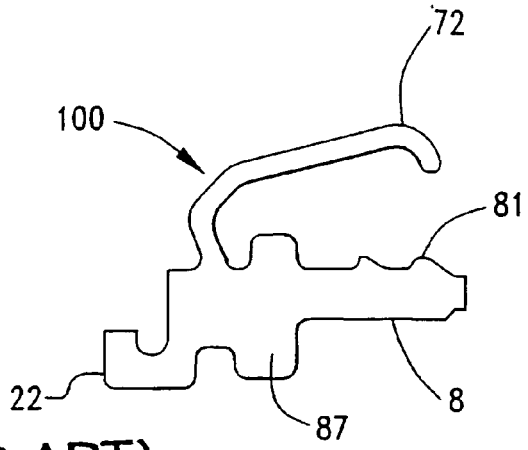
FIG. 4 is a side elevational view of a first type terminal utilized in the connector assembly of FIG. 1.

FIG. 4 illustrates a first type of terminal 100 that is used in the known connectors of FIGS. 1 and 3. This terminal 100 is seen to have a surface mount portion 22, an elongated, cantilevered contact portion 72 that extends into a card-receiving slot of the connector, a body portion 87, and a terminal retention portion 8 that is received within a slot or cavity formed in the connector housing. Barbs 81 are provided as part of the terminal retention portion 8 to increase the retention of the terminal in the connector housing.

Figure 5:
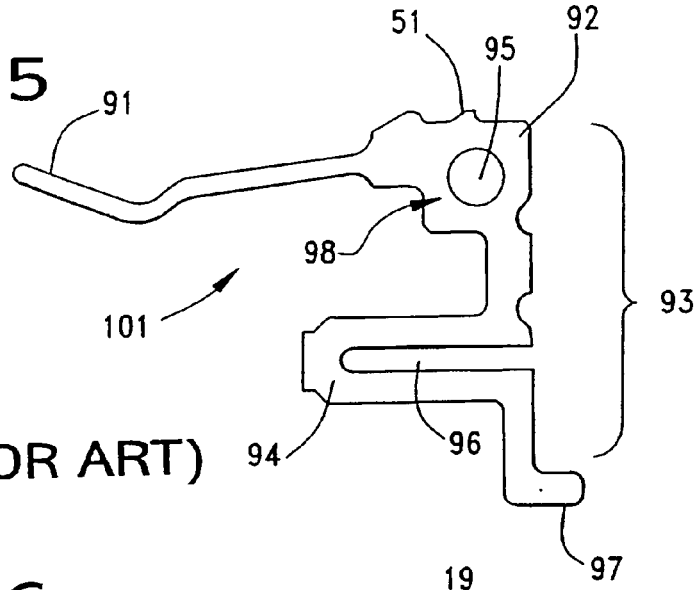
(PRIOR ART) FIG.5
FIG. 5 is a side elevational view of a second type terminal utilized in known connectors.

FIG. 5 illustrates a terminal 101 that are used in the second set (or type) of terminals for known connector housing such as that shown in FIG. 3. The terminal 101 includes an elongated, cantilevered contact portion 91, a first (upper) retention section 92 that is also considered to be part of a terminal body portion 93. A second (lower) retention section 94 is also provided and is spaced apart from the first retention section 92. Both retention sections 92, 94 are disposed on the terminal 101 between the contact portion 91 and the mounting, or tail portion, 97.

The first retention portion 92 includes a relatively large central part 98, which has an opening 95 formed therein. This opening is shown as circular and completely enclosed within the terminal retention area and serves to reduce the metal of the terminal and this particular portion thereof and it also reduces the capacitance of the terminal with respect to any adjoining terminal, by reducing the amount of surface area of the terminal. This reduction of material also increases the inductance of the terminal, which also influences the impedance of the terminal. The reduction of capacitance (or increase in inductance) will in turn, as is known, affect the impedance of the terminal, and of the connector overall in the region from the second terminal contact portion 91 to the mounting portion 97 thereof.

The second terminal retention portion 94 also has an opening 96 formed therein and this opening 96 takes the form of a slot that preferably extends from an edge and through a portion of the central area of the second terminal retention portion 94. This slot 96 is not completely enclosed in the retention portion 94 as in the top retention portion. In the illustrated embodiment, the opening 95 is shown as circular, a variety of other shapes, preferably polygon shapes may be used. The size and shape of this first retention portion 92 may be varied in order to vary the impedance of the system.

Figure 6:
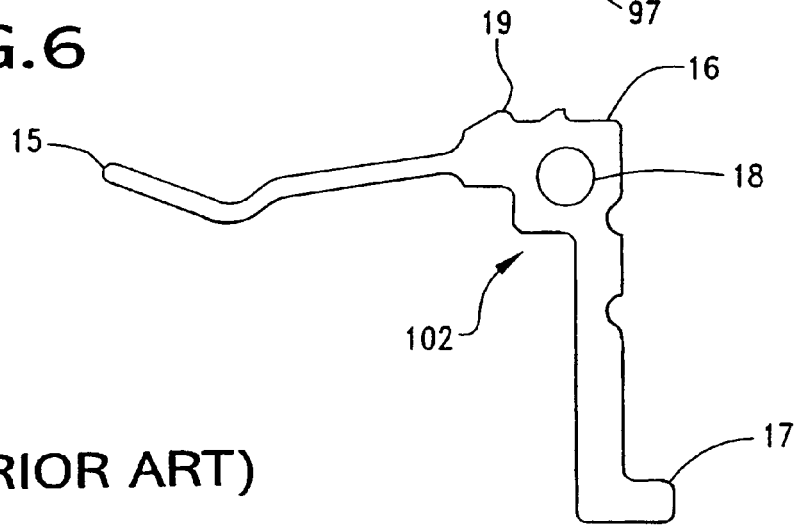
(PRIOR ART) FIG.6
FIG. 6 is a side elevational view of another second type terminal utilized in known connectors.

FIG. 6 illustrates another embodiment of a known second type terminal, where the terminal 102 contains a contact section 15, a single retention section 16, and a board mounting section 17. The retention section 16 of this second terminal 102 also contains an opening 18 therein in which metal has been removed from the stamped terminal 102. In the illustrated embodiment, this central portion is substantially circular, but can also take a variety of shapes. The size and shape of this central portion can be varied in order to vary the impedance of the system. The retention section of the second terminal may contain barbs 19 which are used to embed in the slots of the dielectric housing to provide terminal retention. The size of the board mounting portion 17 may also be varied to provide adequate area for mounting to the printed circuit board, while also being tuned to provide a specific impedance in the terminal.

Figure 7:
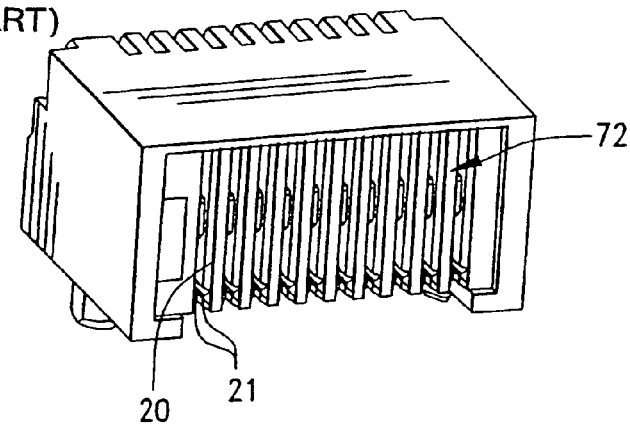
FIG.7 (PRIOR ART)
FIG. 7 is a perspective view of the known connector housing of FIG. 3 with terminals inserted therein.
Figure 8:
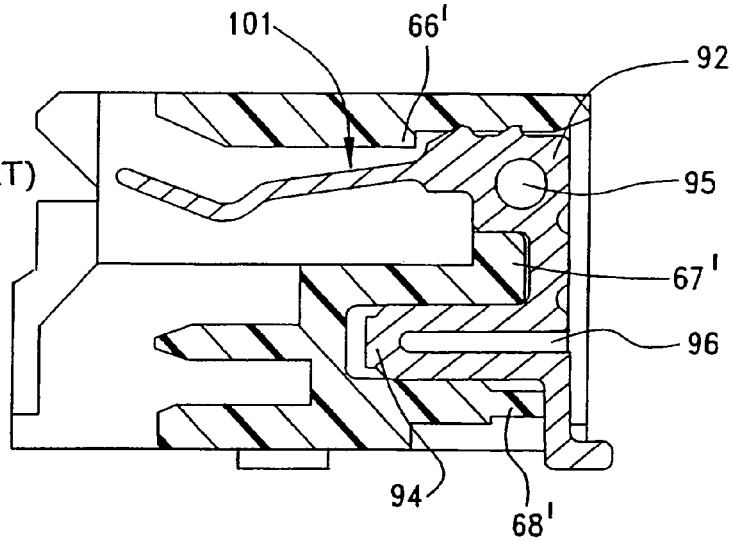
FIG.8 (PRIOR ART)
FIG. 8 is a cross-sectional view of the known connector housing of FIG. 7.
Figure 9:
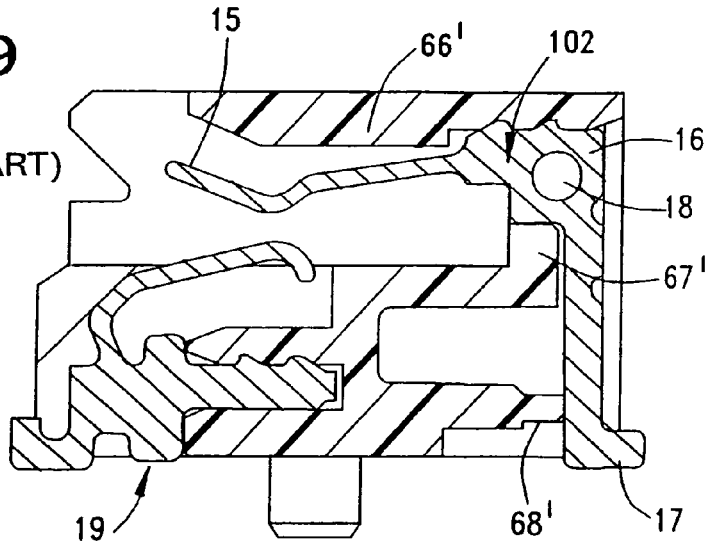
FIG.9 (PRIOR ART)
FIG. 9 is a cross-sectional view of an alternate style of the known connector housing of FIG. 7.

The terminals are easily stamped from sheet metal, but because of the openings 95, 96 formed thereon, a concern is raised about the ability to retain the second terminals 101, 102 within the connector housing 3. This concern is alleviated by modifying the connector housing 3', as illustrated in FIG. 3, in order to provide additional housing material 66', 67' and 68' near the retention slots 90'. The effect of this additional material is shown in FIGS. 8 & 9, where the material 66' and 67' enclose and abut the enlarged terminal first retention portion 92 and in effect, provide additional reaction surfaces against which the retention portions 92, 94 bear. FIG. 9 illustrates how the other second terminal of FIG. 3 is fit into the housings 3' of the known connectors of FIG. 7.

The length and width of the second retention portion can also be varied in order to vary the surface area of the terminal, and therefore also the impedance. Both first and second retention sections of the second terminal may contain barbs, or teeth 51 which are used to embed the terminals 101 firmly and reliably within the slots 72 of the connector housing 3. The size of the board mounting section may also be varied to provide adequate area for mounting to the printed circuit board, while also being tuned to provide a specific impedance in the terminal. In all of the connectors of FIG. 1–9, the terminals are inserted in the connector housing from the front and back faces. It is difficult to provide these type of connector structures with means for orienting a mating connector into mating engagement.

FIGS. 10–16 illustrate a first embodiment of a connector constructed in accordance with the principles of the present invention. In this embodiment, the terminal configuration and arrangement have been changed in order to carry high speed data signals at speeds of at least approximately 2 gigabits per second and greater up to at least 10 gigabits per second and beyond. It has been found in other connectors, especially those known connectors as exemplified by FIG. 2, that certain structural elements adversely affect the ability to carry high speed signals. Mostly, it is due to at least one of the connector terminals, and such a terminal is shown by the first or front terminal 4. The large surface mount portion 20 thereof adds inductance to the overall impedance of such a connector and thus the terminal 4 must act as a low speed terminal.

Figure 10:
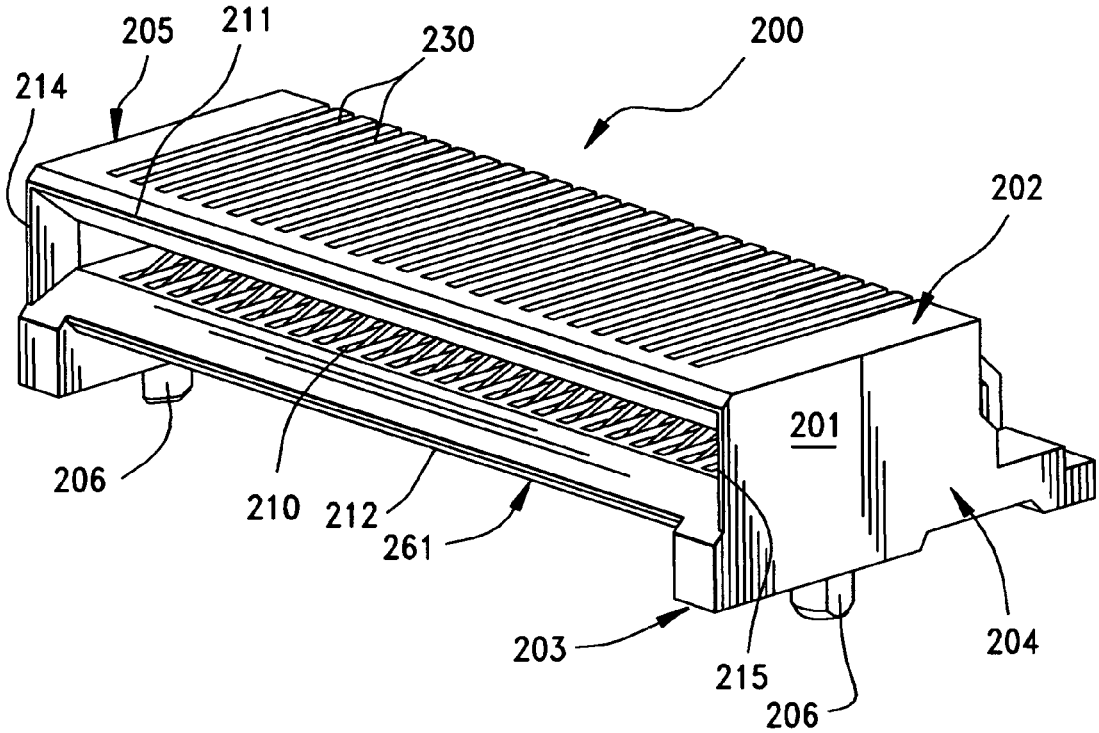
FIG. 10 is a perspective view of an embodiment of a connector constructed in accordance with the principles of the present invention.
Figure 14:
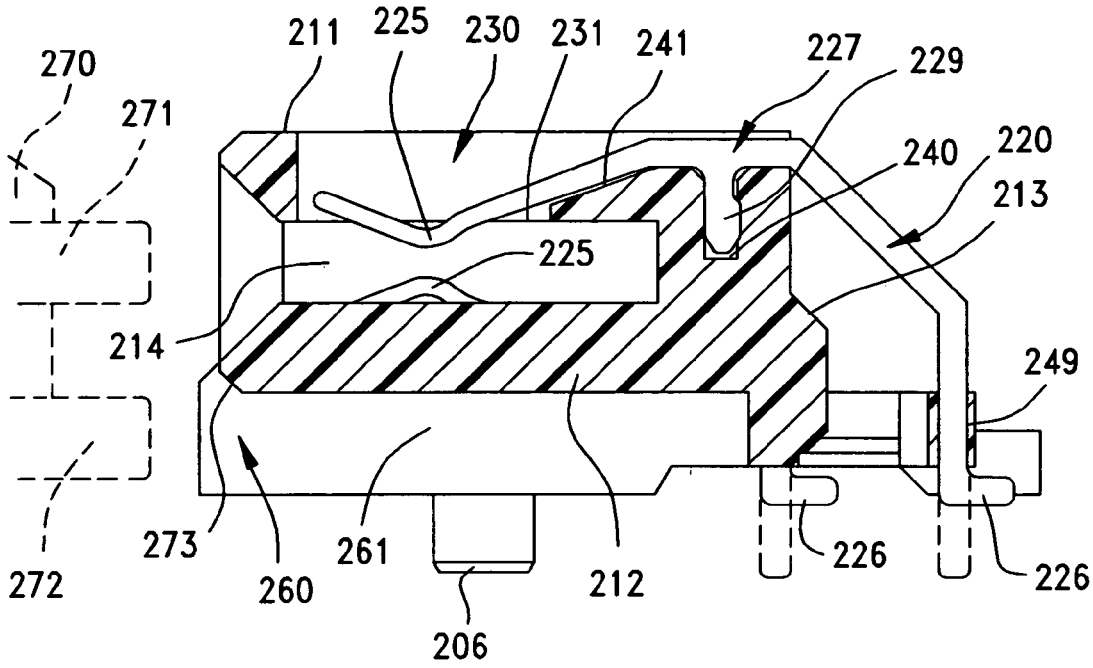
FIG. 14 is a cross-sectional view of the connector of FIG. 10 taken along a line that exposes to view one terminal of the top terminal set of the connector and illustrating its manner of engagement with the connector housing.
Figure 15:
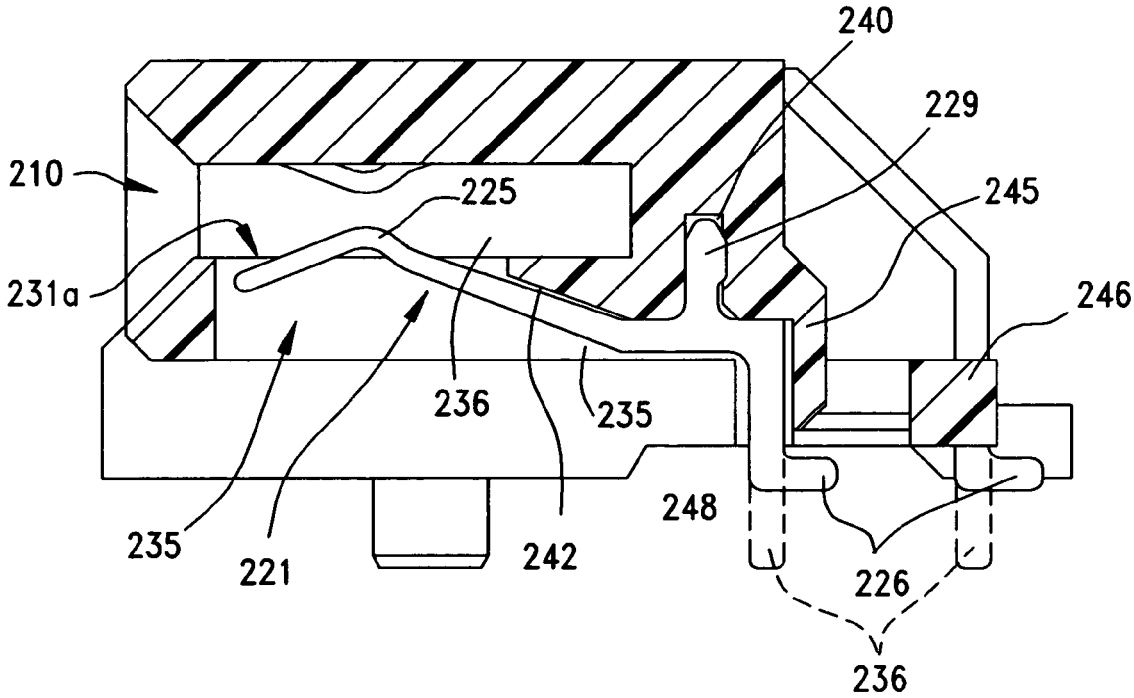
FIG. 15 is a cross-sectional view of the connector of FIG. 10 taken along a line that exposes to view one terminal of the bottom terminal set of the connector and illustrating its manner of engagement with the connector housing.
Figure 16:
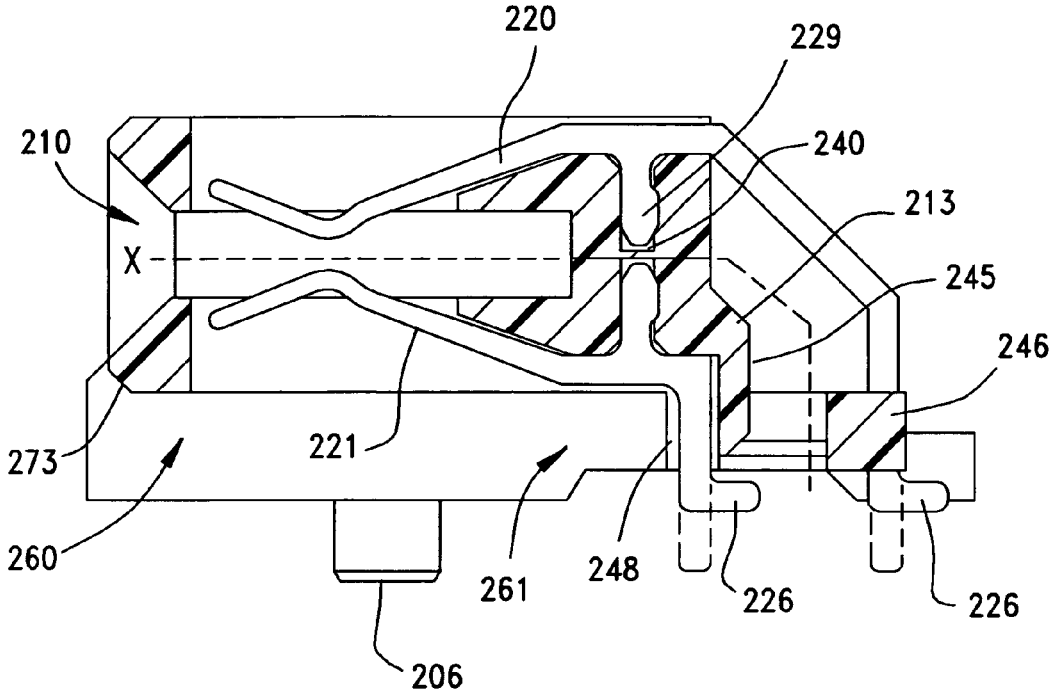
FIG. 16 is a staggered cross-sectional view of the connector of FIG. 10 taken along a line that exposes to view one terminal of each of the top and bottom terminal sets of the connector and illustrating their manner of engagement with the connector housing.

The connectors of this embodiment provide the ability to carry high speed data signals of 2 GBps and greater and approaching approximately 10 GBps. As illustrated in FIG. 10, the connector 200 includes a housing 201 that has a top 202, a bottom 203 and two sides 204, 205. The bottom 203 may include one or more mounting posts 206 that are used to position the connector on a circuit board (not shown). The front of the connector preferably includes a circuit card-receiving slot 210 that receives the leading edge of a circuit card that is typically housed within an electronic module (not shown). As shown in FIGS. 14–16, this slot 210 extends interior of the connector housing 201 and is bounded by a top wall 211, a bottom wall 212, a rear wall 213 and two side walls 214, 215. (FIG. 13.)

The connector 200 includes two distinct sets of thin conductive terminals 220, 221 that extend into the card-receiving slot 210 and which provide an electrical transmission path from circuits on the circuit card to circuits on the larger circuit board. The sets of terminals are similar in that they each include contact portions 225 that extend into the card-receiving slot 210 and tail portions 226 that extend out of the connector housing 201 in opposition to the circuit board to which the connector 200 is mounted. The terminals also include what may be considered as body portions 227 that are disposed intermediate the contact and tail portions and which interconnect them together.

The terminals of the first, or top set, 220 of terminals are inserted into the connector housing 210 in slots 230 that are formed in the top wall 211 of the housing 201. As shown best in FIG. 14, these slots include openings 231 that communicate with the card-receiving slot 210 of the housing 201 and are positioned so that the contact portions 225 of the top terminal set 220 may at least partially extend into the slot 210. The terminals of the second, or bottom, set 221 of terminals are inserted into the connector housing 210 in slots 235 (FIG. 15) that are formed in the bottom wall 212 of the connector housing 201. As shown best in FIG. 15, these slots include openings 231 that communicate with the card-receiving slot 210 of the housing 201 and are positioned so that the contact portions 225*a* of the bottom terminal set 221 may at least partially extend into the slot 210.

Figure 13:
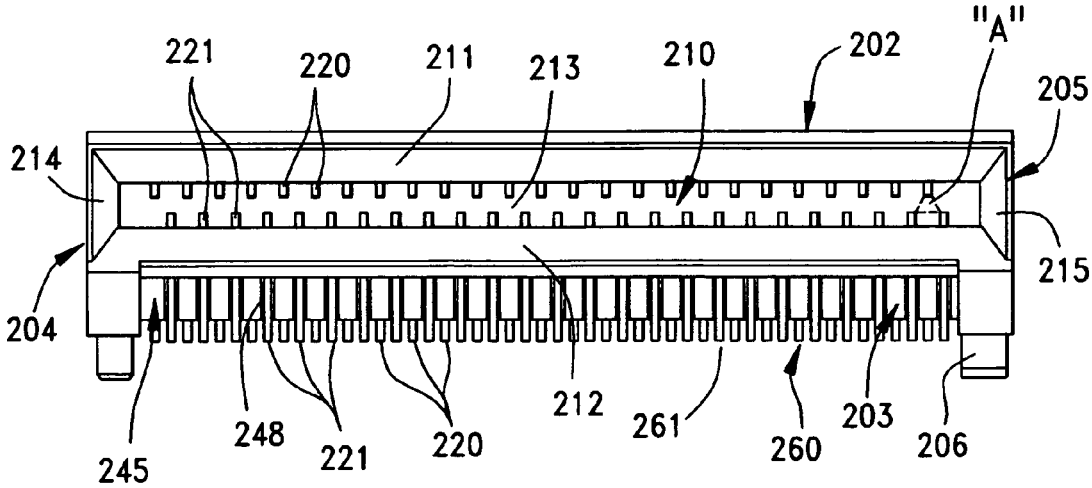
FIG. 13 is a front elevational view of the connector of FIG. 10.

The terminal-receiving slots 230, 235, as best illustrated in FIG. 13, are offset from each other so that the slots 235 that hold the bottom set of terminals 221 are preferably arranged so that they are positioned offset from the terminals 220 that occupy the top set of slots 230. In this fashion, a triangular arrangement of groups of terminals may be effected, with three terminals being positioned at respective apexes of an imaginary triangle, as at "A" in FIG. 13. Such an arrangement is preferably used in differential signal applications with a pair of differential signal terminals (i.e., two terminals carrying the same magnitude voltage signal, but of different polarities, such as +0.5 volts and −0.5 volts) and an associated ground terminal.

The terminals each further preferably include retention portions 229 (FIG. 16), which are illustrated as stubs that primarily serve to retain the terminals in place within the connector housing 201. As illustrated, these terminal retention portions 229 extend into additional cavities 240 that are formed in the housing 201, and which may be formed, as shown, in the rear wall 212 of the connector housing 201. These additional cavities are offset as between the top and bottom sets 220, 221 of terminals, so that the retention portions 229 of the two terminal sets 220, 221 that are received therein extend toward each other.

These retention portions 229 support the terminals 220, 221 in a cantilevered fashion, and the terminal slots 230, 235 may be provided with angled faces 241, 242 that extend toward the card-receiving slot 210 and the slot openings 231, 231*a*. In this manner, the contact portions 225 of each of the terminals of the two terminal sets 220, 221 extends in a cantilevered fashion into the card-receiving slot 210. These angled surfaces 241, 242 also serve as reaction surfaces against which the terminals 220, 221 may be bear if the terminals are stitched in the connector housing 201, which would normally occur if the terminals tail portions were of the through hole type (as illustrated in phantom in FIGS. 14–16).

In order to achieve a close terminal-to-terminal spacing within the card-receiving slot 210, the bottom set 221 of terminals is preferably inserted from the bottom of the connector housing 201. This is achieved without the connector housing losing any significant structural integrity. The main retention of the terminals 220, 221 occurs at the rear wall 213 of the connector housing card-receiving slot 210, and secondary retention is provided by the terminal slots 230, 235.

Although terminal tail portions 226 of the surface mount type are described in detail herein, it will be understood that the connectors of the present invention may also utilize terminals having tail portions of the through hole type 236 as shown in phantom in FIGS. 14–16. Whatever the type of tail portions used for the terminals, it is desired to hold them in position with respect to each other. Rather than employ a separate tail alignment element, the present invention utilizes two different areas of the bottom side 203 of the connector housing 201 to hold the terminal tails 226 in place in a spaced-apart arrangement. The terminal tails 226 are spaced apart from each other lengthwise of the connector 200 and the tails 226, as illustrated in the Figures, are spaced apart along two tail alignment or holding areas 245, 246.

Figure 12:
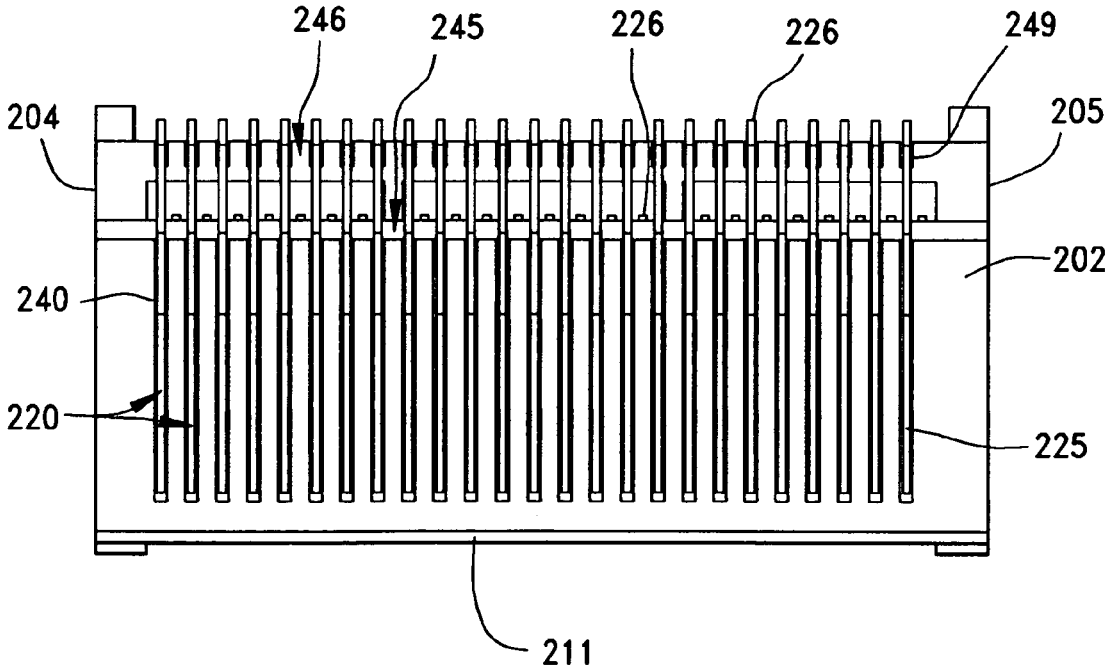
FIG. 12 is a top plan view of the connector of FIG. 10.
Figure 11:
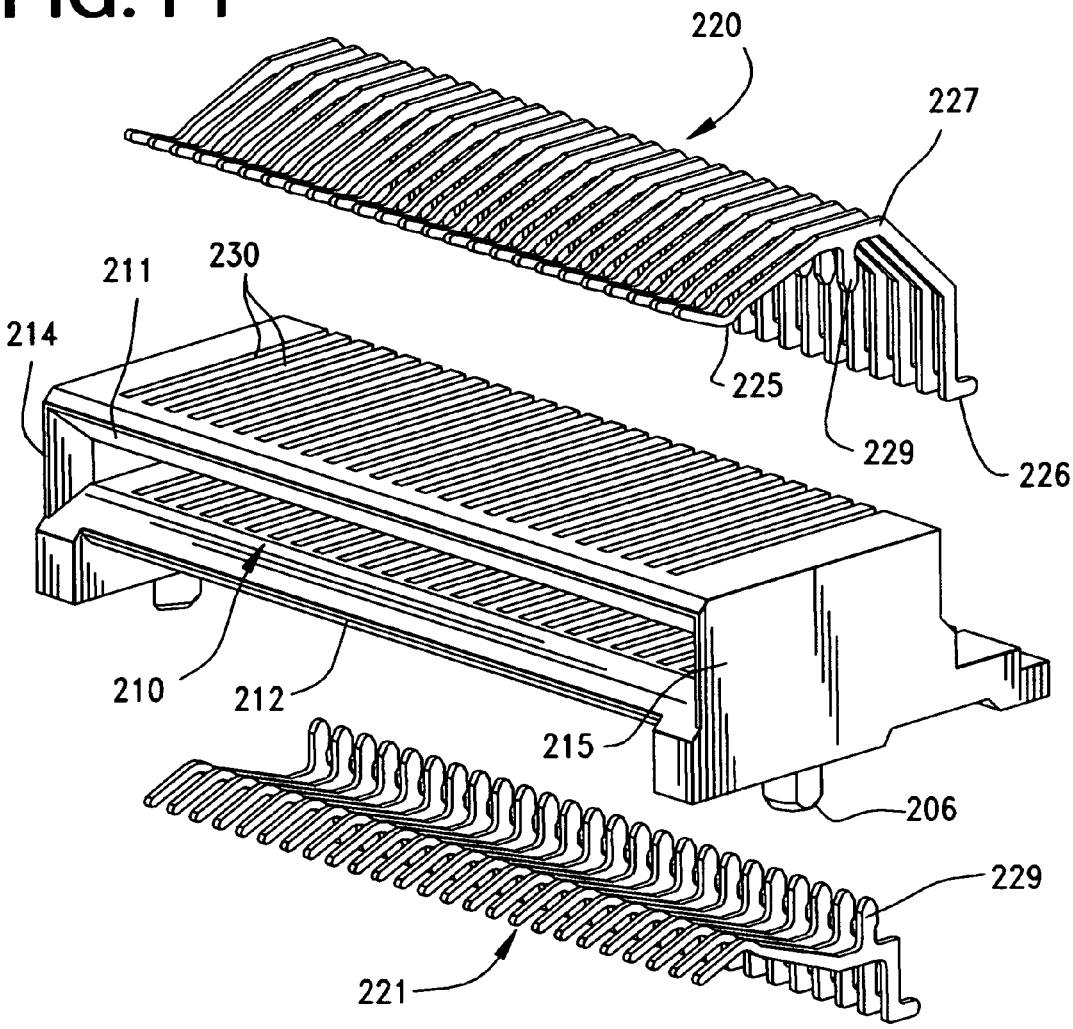
FIG. 11 is an exploded view of the connector of FIG. 10.

These areas include a plurality of tail slots 248, 249, with one set of the slots 248 being arranged so that they face the front of the connector, and the other set of slots being arranged so that they face the rear of the connector 200. The slots 248 also open to the bottom of the connector as shown best in FIGS. 13 & 15, while the slots 249 open to the top of the connector as best shown in FIGS. 12 & 14. It can be seen from FIG. 16 that the terminals 220, 221 of the two terminal sets exhibit a measure of symmetry in that they are generally spaced-apart from each other a common distance along a center dividing axis shown in dashed line at X—X.

Additionally, the retention portions 229 of each of the terminal sets 220, 221 extend toward each other and are of a small size, so that their stub nature does not create a large impedance discontinuity in this area of the connector terminals so that the impedance may be controlled along the extent of the terminals through the connector housing. The use of this symmetry permits the use of high speed terminals in an application that has size constraints.

Figure 17:
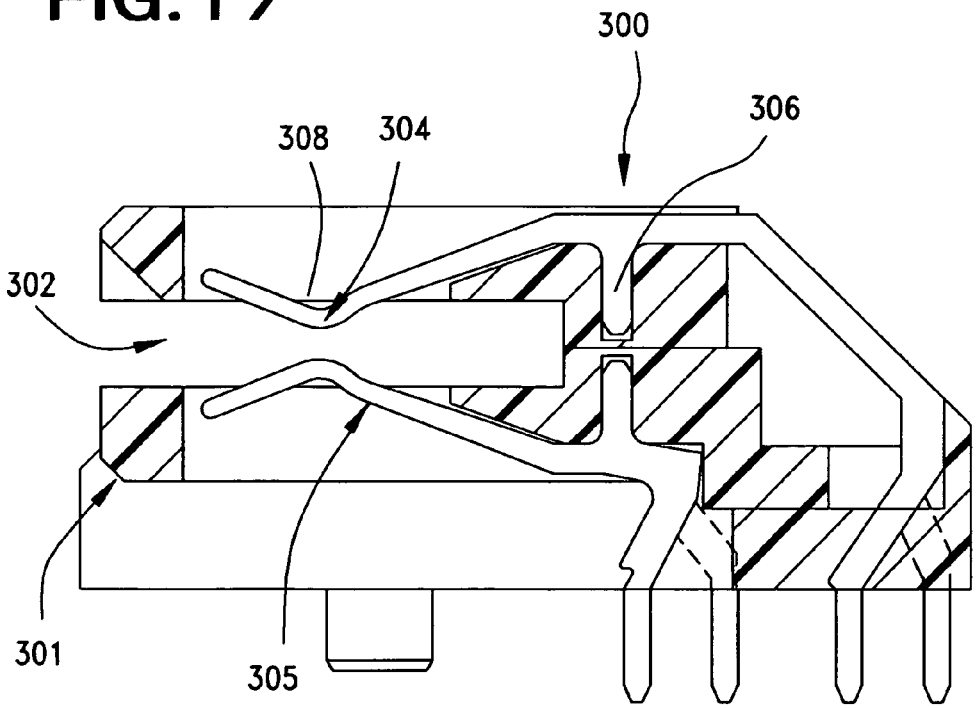
FIG. 17 is a cross-sectional view of an alternate embodiment of a high speed SFP-style connector which has terminal configurations that are best suited for through hole mounting applications.

Turning now to FIG. 17, a through-hole embodiment 300 is illustrated in cross-section. As shown, this embodiment 300 has an insulative housing 301 with a card slot 302 that extends widthwise across the face 303 of the connector housing 301. Two sets of terminals 304, 305 are utilized and are inserted into the connector housing from the top and bottom surfaces thereof as in the connector 200. The terminals have retention portions 306 that fit into cavities to retain the terminals in place and to provide a reaction surface for the cantilevered terminal contact portions 308. The tail portions 309 of the terminals 304, 305 are angled and offset as shown to provide the through hole feature. A thin web of housing material separates the top and bottom terminals as shown.

The connector housing 201 may also include, as shown in the Figures, a hollow area 260 in the form of a recess, that defines a lengthwise slot or cavity 261 underneath the card-receiving slot 210. This slot 261, as shown best in FIGS. 14–16, extends underneath and past the inward extent of the card-receiving slot 210 to a point where, as shown in the connector embodiment 200 of the invention, the recess 260 extends past the beginning of the card slot rear wall 213. Thus, in the illustrated embodiment, the card-receiving slot 210 has an insertion depth less than that of the recessed slot 261. As shown in FIG. 15, the bottom terminal row tail slots 248 open to this hollow recess 260. Because the bottom row of terminals 221 are inserted directly from the bottom of the connector, the recess 260 may be formed in the connector housing without fear of adversely affecting the structural integrity of the connector 200.

As shown in FIG. 14, the slot 261 defined by the recess will act as a "keyway" and receives a projecting member 272 that extends from an opposing mating connector 270 that supports a circuit card 271, all of which are illustrated in phantom. The projecting member 272 will fit into the slot when the opposing mating connector 270 is oriented in a proper mating position and it will interfere with the top edge of the connector 200 if the opposing mating connector is oriented improperly, such as upside down. In order to facilitate the entry of the projecting member 272, the front, upper edge of the recess may be provided with an inwardly angled surface 273 that will act as a lead-in surface to the slot 261.

Figure 18:
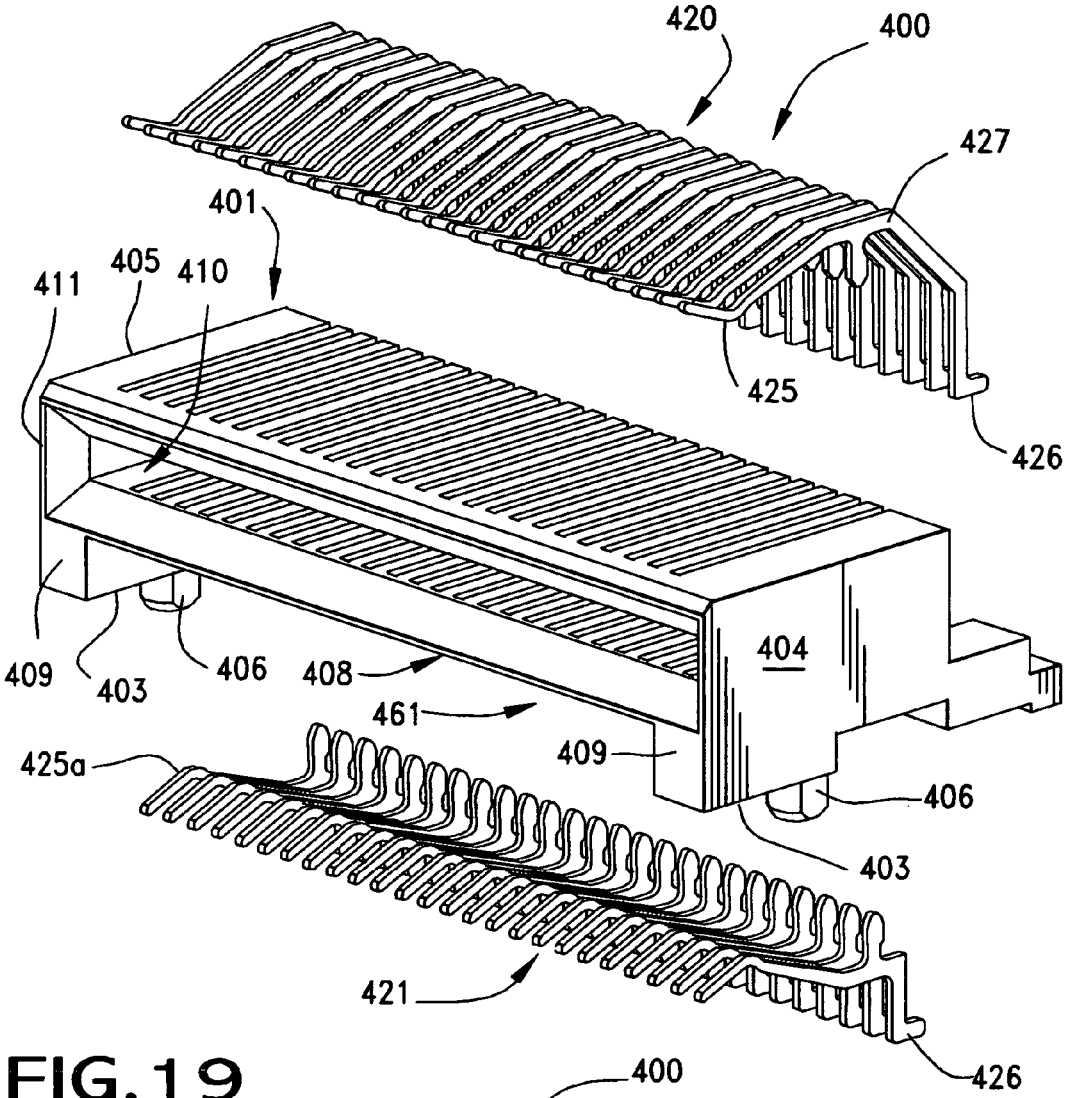
FIG. 18 is a perspective view of another embodiment of a connector constructed in accordance with the principles of the invention.
Figure 19:
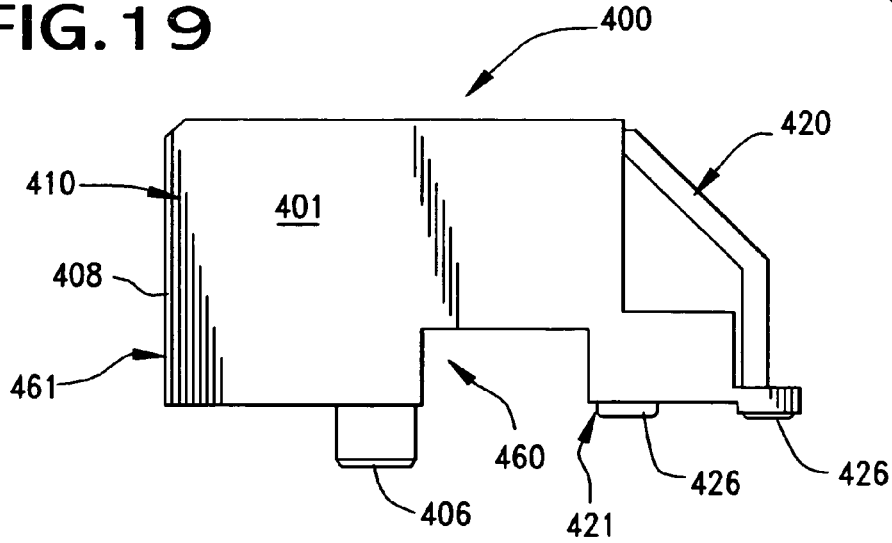
FIG. 19 is a side elevational view of the connector of FIG. 18.

Additional savings of material and enhancement of performance can be provided by lessening the bulk of the bottom 203 and sides 204, 205 of the connector 200. This is illustrated in FIG. 18 and FIG. 19 as connector 400. By omitting or removing material from the housing 401 at its sides 404, 405, additional open space is provided in the bottom 403 and the sides 404, 405 that provides for greater airflow to the underside of the connector housing which may aid in the assembly of connectors of the invention to a circuit board by processes such as reflow soldering and the like. In effect, projecting positioning members are thereby provided for maintaining proper spacing of the various components while adding the materials savings and performance enhancement characteristic of this embodiment.

Terminals 420 of the top or first set of terminals have contact portions 425, tail portions 426 and body portions 427. Terminals 421 of the lower or second set of terminals have contact portions 425*a* and tail portions 426. Also included is a card-receiving slot 410 and a hollow area 460 having a lengthwise slot or cavity 461 to receive a projecting member 272 extending from a connector that mates with the "keyway" or cavity 461 while a circuit card of the mating connector mates with the slot 410.

It will be noted that the front face surfaces, generally designated 408, of the housing 401 of this embodiment are substantially coplanar, with the front portions 409 of the face 408 lying substantially the same plane as the frame 411 of the face 408 which circumscribes the slot 410. Such an approach further reduces material needed for making the housing 401 of this embodiment.

Figure 20:
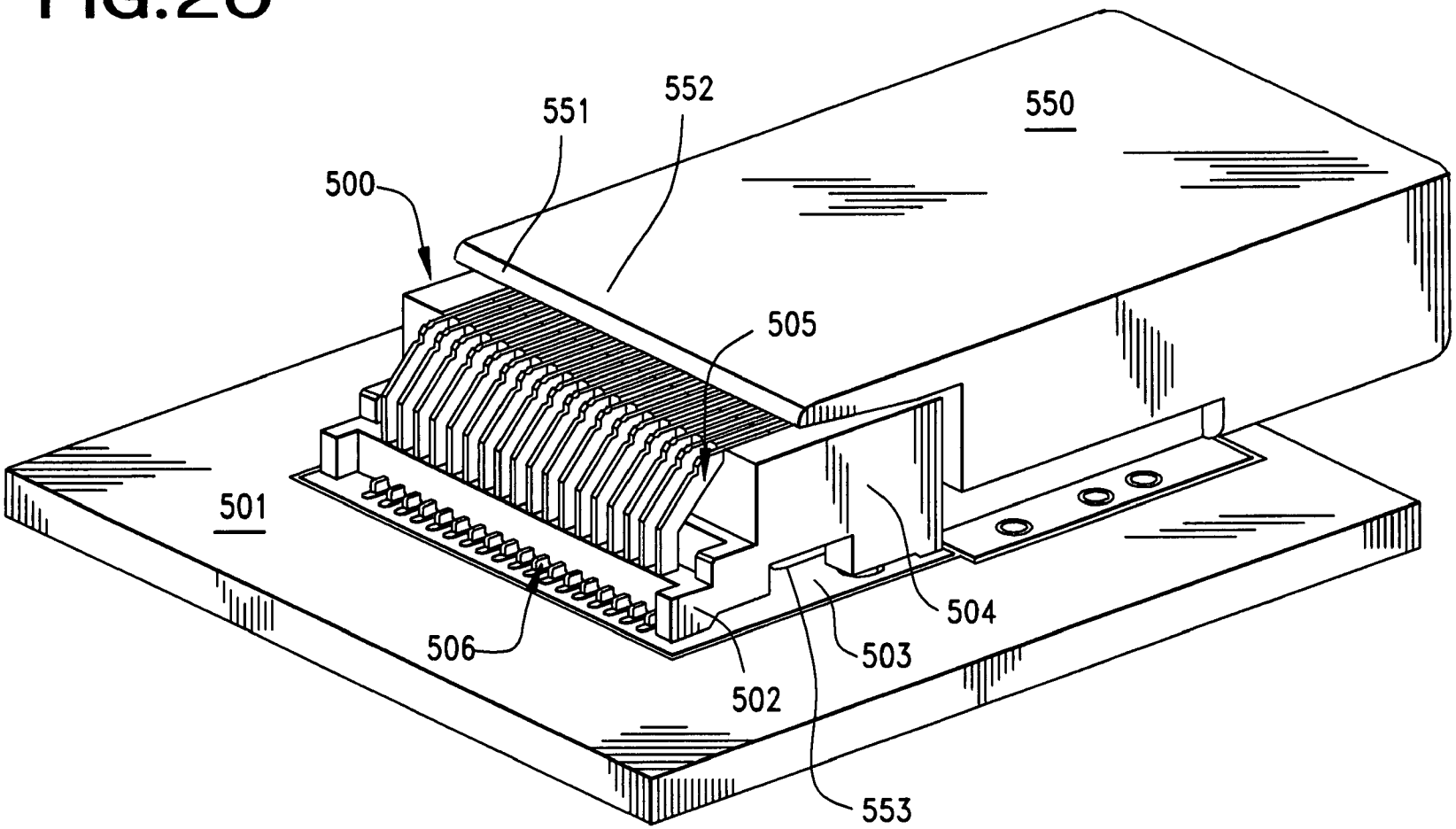
FIG. 20 is a perspective view of a receptacle connector of the invention with a plug connector mated thereto, the wires of the plug connector having been removed for clarity.
Figure 21:
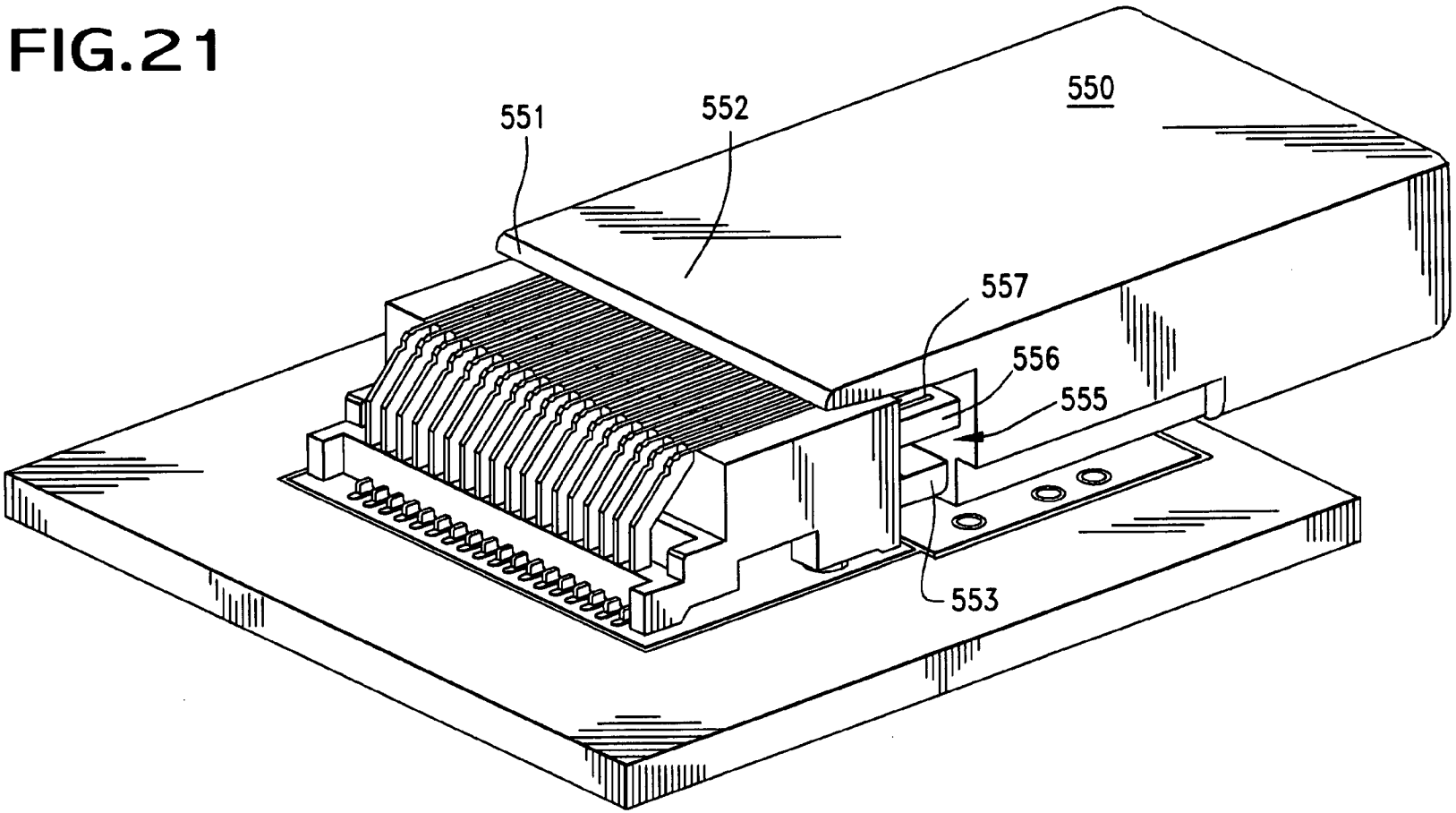
FIG. 21 is the same view as FIG. 20, with the plug connector partially removed from the receptacle connector.
Figure 22:
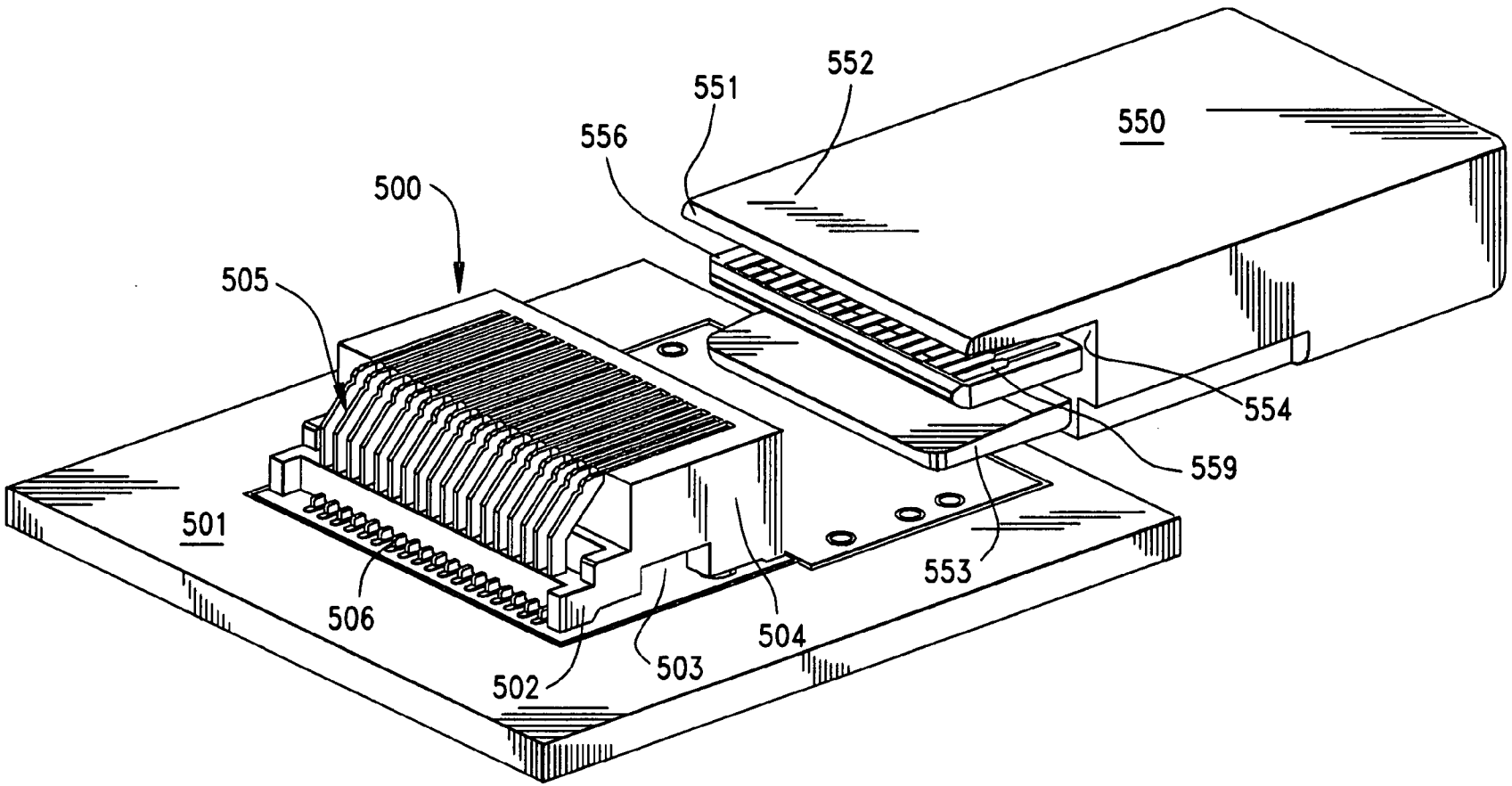
FIG. 22 is the same view as FIG. 21, but with the plug connector completely removed from the receptacle connector; and, FIG. 23 is an elevational view, taken from the side, of the plug connector aligned with the receptacle connector prior to mating.
Figure 23:
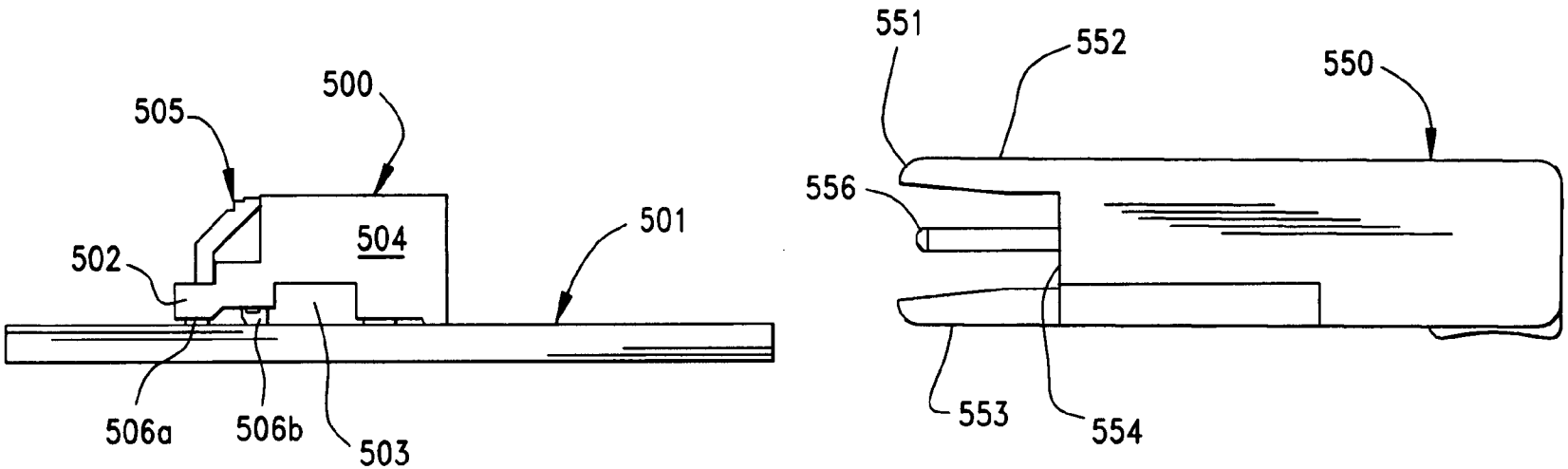

FIGS. 20–24 illustrate a connector of the invention mating with a plug connector. In FIG. 20, the connector 500 is illustrated as mounted to a circuit board 501, such as by soldering. The terminals 505 used in this 500 connector have surface mount feet 506 which are aligned in two spaced apart rows as shown in FIGS. 18 & 19. As with the other embodiments, the terminals are inserted into the insulative connector housing 504 from the top and bottom sides thereof.

A plug connector 550 is shown in FIG. 20 as mated with the receptacle connector 500. As illustrated best in FIG. 22, the plug connector has an insulative housing into which wires or cables (not shown) are fed and the conductors thereof are terminated to traces or contact pads on a circuit card 556. The circuit card has a forward edge that is received within the card-receiving slot of the connector housing 504 and the circuit card has a plurality of conductive traces or pads 559 disposed on the top and bottom surfaces thereof. The circuit card 556 projects forwardly past the front edge, or face 554, of the plug-connector housing and the plug connector includes, as shown, a pair of flanges, illustrated in the FIGS. As top and bottom flanges, respectively 552 and 553. These flanges are spaced apart from each other as shown in FIG. 24, so as to define an intervening space that surrounds, or encloses the projection portion of the circuit card 556. The lower flange 553 of the plug connector 550 is received within the cavity or recess 503 beneath the card-receiving slot of the receptacle connector 500 and between the sidewalls thereof.

Importantly, the connector slot 503 receives the lower flange 553 of the plug connector. The width of the lower flange 553 is less than the width of the upper flange 552 so as to fit into the slot 503 and so as to prevent the upside-down, incorrect mating of the two connectors 500, 550 together. Both the upper and lower flanges 552, 533 extend for a preselected distance over the respective top and bottom sets of terminals as best shown in FIG. 20. The flanges therefore prevent electrostatic discharges from occurring during mating in that they prevent conductive materials such as the traces on the circuit board or other conductive aspects of the plug connector from contacting the terminals and creating a static discharge. The flanges are formed from an insulative material to accomplish this. When mated, the plug connector flanges 552, 553 further prevent accumulation of contaminants on the terminals by covering their forward extent.

While the preferred embodiment of the invention have been shown and described, it will be apparent to those skilled in the art that changes and modifications may be made therein without departing from the spirit of the invention, the scope of which is defined by the appended claims.

The invention claimed is:

1. A connector for providing a connection between a circuit board and an opposing electronic element, the opposing electronic element including a male portion having a plurality of conductive members disposed thereon, and a projecting member distinct from said male portion, said connector comprising:

an insulative connector housing having a mating face including a receptacle portion and a mounting face at a location spaced apart from said mating face;

a plurality of conductive tenninals supported by said housing, the terminals being arranged in distinct sets of first terminals and second terminals having contact portions, said first set of terminals and said second set of terminals being positioned in generally opposing relationships so as to provide a contacting pathway containing said contact portions; and a recess of the connector housing, said recess defining a lengthwise slot that is spaced from said contacting pathway, the slot receiving the projecting member of an opposing mating connector, and the contacting pathway having an insertion depth that is less than that of said lengthwise slot.

2. The connector of claim 1, wherein said first set of terminals and said second set of terminals are secured to said housing while said contact portions are positioned to extend into said contacting pathway and be moveable outwardly therein in response to engagement by an opposing electronic element.

3. The connector of claim 2, wherein each said terminal has a body portion between the contact portion and tail portion of said terminal, and wherein each said body portion is at least partially embedded within said housing.

4. The connector of claim 3, wherein said body portion has a retention portion secured to said housing.

5. The connector of claim 4, wherein said retention portion is a projection received within said housing.

6. The connector of claim 1, wherein said first set of terminals is laterally offset from said second set of terminals.

7. The connector of claim 1, wherein each of said terminals includes a cantilevered portion which includes said contact portion, and said housing includes a slot which accommodates said cantilevered portion, said slot having an angled face that extends toward the contacting pathway.

8. The connector of claim 1, wherein said first set of terminals is spaced from set second set of terminals by a common distance along a center dividing axis of the housing.

9. The connector of claim 3, wherein said tail portion and housing each provide a through hole feature.

10. The connector of claim 1, wherein said first set of terminals and said second set of tenninals are positioned onto said housing in opposite directions from outside of the housing.

11. The connector of claim 10, wherein said first set of terminals are received in into said housing along a top side thereof and said second set of terminals are received in said housing along a bottom side thereof.

12. The connector of claim 1, wherein said mating face of the housing defines an external end of the contacting pathway and an external end of the lengthwise slot.

13. The connector of claim 12, wherein said external ends are substantially coplanar.

14. A connector for providing a connection between a circuit board and an opposing electronic element, the circuit board having a plurality of conductive traces disposed thereon and the opposing electronic element including a male portion having a plurality of conductive members disposed thereon, comprising:

an insulative connector housing having a mating face including a receptacle portion for receiving the male portion of the opposing electronic element and a mounting face for mounting said connector housing to said circuit board;

a plurality of conductive terminals supported by said housing, the terminals being arranged in distinct sets of first and second terminals on opposing faces of said connector housing, the first and second terminals including contact portions for contacting corresponding conductive members of said opposing electronic element, tail portions for mounting said terminal to a circuit board, body portions interconnecting the terminal contact and mounting portions together, and retention portions for retaining the terminal in place with the connector housing, the terminal retention portions being disposed intermediate said terminal contact and terminal mounting portions and extending into said connector housing from said opposing faces; and, the connector housing includes a recess formed on its bottom, the recess defining a lengthwise slot that is positioned underneath said receptacle, the receptacle receiving a projecting member of an opposing mating connector.

15. The connector of claim 14, wherein said first set of terminals is laterally offset from said second set of terminals.

16. The connector of claim 14, wherein each said connector has a cantilevered portion which includes said contact portion, and said housing includes a slot which accommodates said cantilevered portion, and said slot has an angled face that extends toward the connector housing receptacle portion.

17. The connector of claim 14, wherein said connector housing receptacle portion has an insertion depth which is less than that of said lengthwise slot.

* * * * *